United States Patent [19]

Daenen

[11] 4,112,799

[45] Sep. 12, 1978

[54] CUTTING APPARATUS

[75] Inventor: Bernardus Daenen, Uitgeest, Netherlands

[73] Assignee: Van der Molen Machinefabriek B.V., Zaandam, Netherlands

[21] Appl. No.: 764,173

[22] Filed: Jan. 31, 1977

[30] Foreign Application Priority Data

Feb. 13, 1976 [NL] Netherlands ..... 7601478

[51] Int. Cl.[2] ..... A24B 7/00

[52] U.S. Cl. ..... 83/409; 83/276; 83/510; 226/95

[58] Field of Search ..... 83/276, 277, 509, 510, 83/511, 512, 543, 409; 226/95, 158

[56] References Cited

U.S. PATENT DOCUMENTS

| | | | |
|---|---|---|---|
| 2,316,784 | 4/1943 | Gladeck | 83/512 X |
| 2,933,003 | 4/1960 | Wheeler et al. | 83/512 X |
| 3,152,497 | 10/1964 | Godfrey | 83/512 X |

*Primary Examiner*—J. M. Meister

*Attorney, Agent, or Firm*—Stevens, Davis, Miller & Mosher

[57] ABSTRACT

An apparatus for cutting wrapper for cigars from a ribbon, comprising a frame including a guide for a conveyor, a conveyor belt parallel to said guide passed over rollers in the frame, a blade cooperating with cutter means and corresponding with the contour of a wrapper, a conveyor movable over the guide and being at some distance above the conveyor belt and parallel thereto, a support means for a roller of tobacco ribbon, a suction head spaced a little from the conveyor belt, which is located directly behind the support means for the roller of tobacco ribbon, outside the track of travel of the conveyor, means for moving the conveyor over the guide and pneumatic means connected to the drive of the conveyor to govern the control functions of the apparatus.

5 Claims, 3 Drawing Figures

CUTTING APPARATUS

Applicants' prior patent application in Holland (No. 75,02839) describes an apparatus for manufacturing a ribbon from strips of tobacco leaf, which is subsequently wound with a carrier to form a roll.

In order to process the resulting ribbon rapidly and efficiently into a wrapper, in particular cutting it in contour, applicants have developed an apparatus which mainly comprises a frame including a guide for a conveyor, a conveyor belt parallel to said guide passed over rollers in the frame, a blade corresponding with the contour of a wrapper and coacting with cutter means, a conveyor movable over the guide at some distance above the conveyor belt and parallel thereto, a support means for a coil of tobacco ribbon, a suction head at some distance from the conveyor belt, which is arranged directly behind the support means for the roller of tobacco ribbon, outside the track of travel of the conveyor, means for moving the conveyor over the guide and pneumatic means connected to the drive of the conveyor to govern the control functions of the apparatus.

A simple drive for the conveyor is that in which the latter is connected to a tension spring on the one hand and to a chain or a similar flexible connection on the other, which chain is passed over a roller mounted on the end of a bell crank lever, the other end of which lever supports a roller which coacts with a cam disc actuated by a motorically driven shaft, the chain end being secured to the machine frame.

The pneumatic circuit can be controlled in various ways. Efficient is a control in which the cam disc is combined with one or more cam discs, which actuate the switching means for the pneumatic circuit.

The invention will now be described with reference to the drawings, in which.

Figure 1:
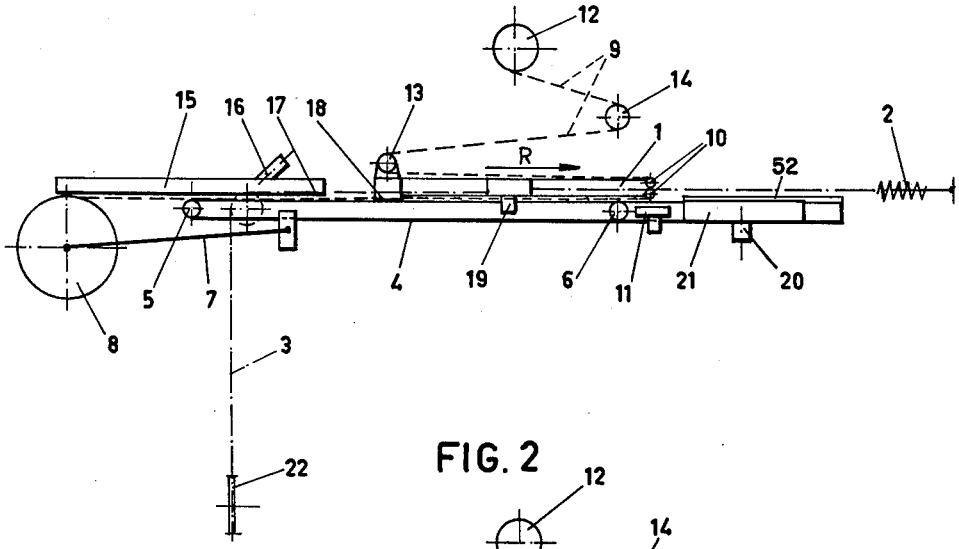
FIG. 1 is a schematic side elevation view of the new apparatus in the starting position.

The apparatus according to the invention mainly comprises a frame not described in greater detail. Said frame can form part of a prior wrapping machine. A conveyor 1 is movable over a guide 51, said conveyor being connected to a tension spring 2 on the one hand and to a chain or similar flexible member 3 on the other. Mounted on the frame is an endless conveyor belt 4 which passes over rollers 5 and 6.

Connected to the frame is a support arm 7 to support a reel or roller 8, on which tobacco ribbon with a carrier 9 is wound. This ribbon and carrier combination is passed over the upper part of conveyor belt 4, the tobacco ribbon being on the bottom, i.e., facing said belt. On the leading end (on the right in the drawing) of the conveyor 1 there are included rollers 10 for returning carrier 9 to a winding reel 12 via bypass rollers 13 and 14, of which roller 13 is mounted on the rear side of conveyor 1 (on the left in the drawing). Numeral 11 designates a vacuum box serving to keep the tobacco ribbon pressed down during cutting.

Above roller 5 and free from conveyor belt 4 is a suction head 15, the connection to a vacuum source of which is indicated by 16. Suction head 15 has a clamp 17, the purpose of which will be discussed later on. Also on conveyor 1 adjacent to end pulley 13 for carrier 9 a clamp 18 is present, the operation of which will also be explained later on.

Numeral 19 indicates a connection for a fluid in vacuum, with which certain functions of the conveyor are governed.

Connected to conveyor belt 4 is a forming block 20 having an inlet 21 for a control fluid. The contour of this forming block corresponds with the contour of the tobacco ribbon to be cut, viz, with that of a wrapper for a cigar.

Figure 3:
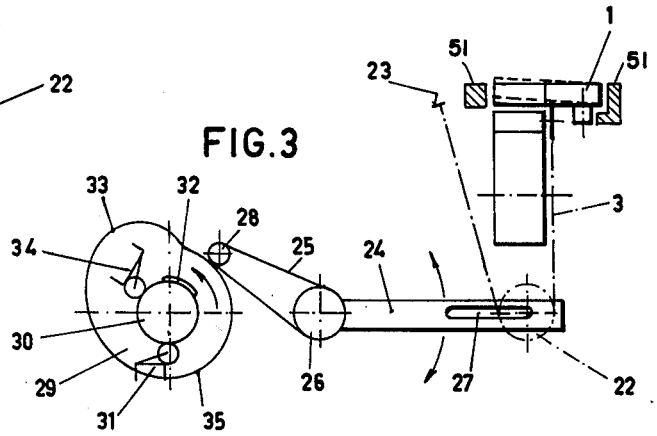
FIG. 3 is a view in the direction of the arrow shown in FIGS. 1 and 2.

Chain 3 or the like is passed over a roller 22 (FIG. 3) and has its end secured to the frame at 23. Roller 22 is mounted on the end of a bell crank lever 24,25 with the rotary shaft 26.

Through an oblong hole 27 in lever part 24 the operative stroke of chain 3, hence the track of conveyor 1 over its guide, can be adjusted. By adjustment of the fixed point 23 the place of the track of travel for conveyor 1 can be determined.

On the end of lever part 25 is disposed a contact roller 28 running on a cam disc 29 on shaft 30 of the machine. Numerals 31 and 34 designate switches controlled by a cam disc 32 and which in turn produce the control signals for the functioning of the pneumatic means and the means connected thereto in the operation cycle.

Figure 2:
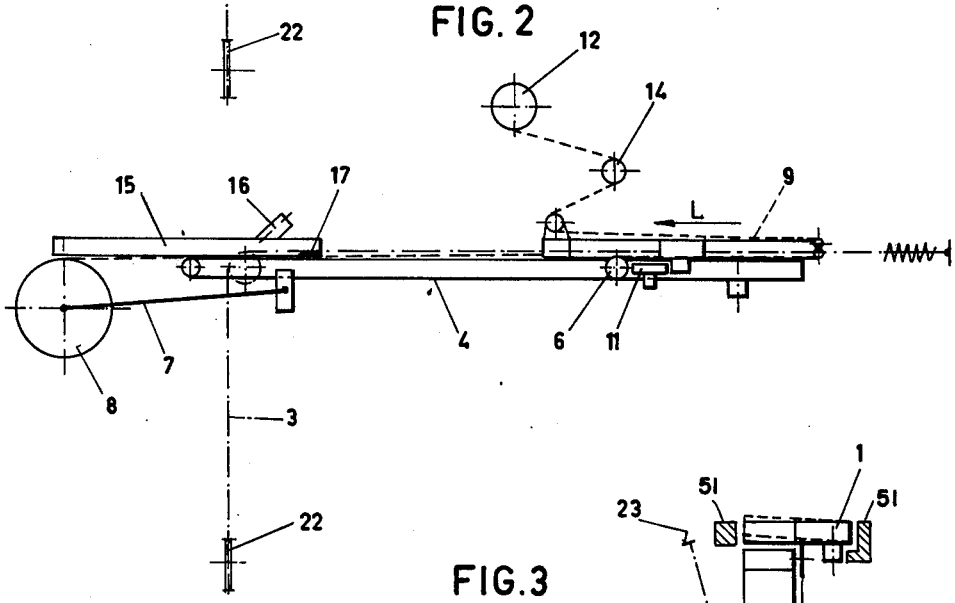
FIG. 2 is a view in accordance with FIG. 1, but in the final position

The apparatus according to the invention as shown in the drawings operates as follows:

When machine shaft 30 rotates, the various cam discs, among others 29 and 32 rotate therewith. Cam disc 29 causes roller 28 to deflect when the larger part 33 of said disc comes into contact with said roller. Lever part 25 pivots on pivot 26 and moves arm portion 24 downwardly. Roller 22 follows this downward movement, during which chain 3 is tensioned. Hence conveyor 1, connected to chain 3, moves over its guide in the frame in a direction shown in FIG. 2 by arrow L (to the left). Spring 2 is thereby tensioned. The final position of the leftward movement is shown in FIG. 1. After roller 8 with tobacco ribbon and carrier 9 is mounted, this combination is passed over conveyor belt 4 and carrier 9, which forms the upper part of said combination, is passed over rollers 10, 13 and 14 to winding roller 12. During operation this roller 12 is motorically intermittently driven. For setting up purposes the carrier 9 at the beginning of roller 8 will be chosen longer than the ribbon length, so that little or no expensive material is lost.

The suction head 15 has via connection 16 a sucking effect on the tobacco ribbon, for carrier 9 is perforated. By operating clamp 19 pneumatically or otherwise the tobacco ribbon, carrier and conveyor belt 4 are urged against clamp 19. Belt 4 runs free on rollers 5 or 6 and is then driven by the conveyor. When the conveyor is moved to the right in the direction of arrow R in FIG. 1, that is, when roller 28 has contacted the narrower cam part 35, chain 3 will be released because arm portion 24 with roller 22 moves upwardly and spring 2 pulls on the conveyor. The tobacco ribbon-carrier combination is entrained with the upper part of the conveyor belt 4 by conveyor 1 as soon as possible after a small displacement by spring 2, i.e., clamp 17 is disengaged and clamp 18 is operated. In the final position (FIG. 2) the movement of conveyor 1 is reversed, that is, the broader part 33 of the cam disc has come into contact with roller 28. The direction of rotation of cam disc 29 is indicated by an arrow. When the conveyor is reversed, roller 12 is driven and carrier 9 is wound on the roller for subsequent use. Through connection 21 a vacuum is drawn in forming block 20, so that the tobacco ribbon adapts to the form. The tobacco ribbon is kept pressed down by vacuum box 11. Upon reverse movement of conveyor 1 a roller or a set of rollers is moved over the forming block, which is surrounded by a blade edge 52 the contour of which corresponds with that of a wrapper. During the cutting operation, forming block 20 is moved slightly downwardly, so that the contour of the wrapper is accurately cut out. Scrap can be removed by suction.

The transport length for the conveyor is accurately adjustable to the cutting length of the wrapper by adjustment of roller 22 at the end of lever arm 24.

To prevent tobacco ribbon and carrier from being moved back during the reverse movement of conveyor 1, clamp 17 in suction head 15 is operated. As a result, the carrier, ribbon and belt 4 are urged to clamp 17 and this system becomes stationary until the direction of movement of conveyor 1 is reversed again. Vacuum is used to prevent tobacco from running along with the roller. Via connection 16 vacuum can be sucked in head 15, by which it is prevented that the tobacco ribbon is entrained with the roller 8.

The cut-out ribbon portion, consequently the finished wrapper, can be removed from the blade edge by a vacuum head or otherwise in the position shown in FIG. 1 and can be transported for further processing.

I claim:

1. An apparatus for cutting wrapper for cigars from a ribbon, comprising a frame, a guide for a conveyor mounted on said frame, a conveyor movable on said guide, an endless conveyor belt positioned beneath said conveyor parallel to said guide and passing over rollers mounted on said frame, a support means for a roll of tobacco ribbon mounted on said frame, a suction head spaced above said conveyor belt and located directly behind the support means but in front of said conveyor, means for moving the conveyor over the guide, clamp for the conveyor with which the combination tobacco ribbon-carrier and belt can be urged to the conveyor, pneumatic means connected to the conveyor moving means to govern the control functions of the apparatus and clamp, a blade and a forming block corresponding to the contour of the wrapper positioned at one end of said conveyor belt.

2. The apparatus according to claim 1, including a tension spring connected to one end of said conveyor, a chain connected at one end to the other end of said conveyor, a bell crank lever having rollers mounted at each end thereof and a rotatable cam disc coacting with one roller, said chain passing around said other roller and having one end thereof anchored to said frame.

3. The apparatus according to claim 2, including switching means on said cam disc combined with at least one cam disc to govern the pneumatic means.

4. The apparatus according to claim 1, including a carrier for the tobacco ribbon, bypass rollers for the carrier, and a fixed, drive roller mounted on the frame on which the carrier can be wound.

5. The apparatus according to claim 1, including a clamp for the suction head with which the combination tobacco ribbon-carrier and conveyor belt can be urged to the clamp.

* * * * *